United States Patent [19]

Montrouil

[11] 4,115,964

[45] Sep. 26, 1978

[54] WINDOWS AND METHOD OF MAKING THE SAME

[75] Inventor: George W. Montrouil, Palo Alto, Calif.

[73] Assignee: Montrouil Enterprises, Inc., Palo Alto, Calif.

[21] Appl. No.: 603,046

[22] Filed: Aug. 8, 1975

[51] Int. Cl.[2] ..... E04H 3/08

[52] U.S. Cl. ..... 52/106; 52/208; 52/764; 52/772

[58] Field of Search ..... 52/106, 235, 498, 495, 52/494, 727, 208, 213, 217, 501; 49/505; 109/31, 38

[56] References Cited

U.S. PATENT DOCUMENTS

| | | | |
|---|---|---|---|
| 1,956,963 | 5/1934 | Salmer | 85/45 |
| 2,043,207 | 6/1936 | Bayley | 52/106 |
| 2,386,151 | 10/1945 | Trautvetter | 52/213 |
| 2,503,537 | 4/1950 | Youngblood | 52/727 |
| 2,771,970 | 11/1956 | Geyser | 52/215 |
| 3,266,207 | 8/1966 | Biram | 52/235 |
| 3,380,210 | 4/1968 | Neal | 52/235 |
| 3,566,565 | 3/1971 | Pond | 52/208 |
| 3,800,488 | 4/1974 | Swanson | 52/217 |
| 3,858,375 | 1/1975 | Silvernail | 52/235 |
| 3,906,671 | 9/1975 | Maldonado | 52/212 |

FOREIGN PATENT DOCUMENTS

| | | | |
|---|---|---|---|
| 1,113,555 | 9/1961 | Fed. Rep. of Germany | 52/106 |
| 449,218 | 4/1968 | Switzerland | 49/505 |
| 724,129 | 2/1955 | United Kingdom | 52/498 |

*Primary Examiner*—Price C. Faw, Jr.
*Assistant Examiner*—Henry Raduazo
*Attorney, Agent, or Firm*—Lowhurst & Aine

[57] ABSTRACT

Several embodiments of window frame assemblies comprising novel window framing members for supporting a glazing product are described. In one embodiment, a window frame assembly is described comprising a conventional framing member including a novel rotatable rod means for preventing the cutting through of the framing member as by a saw. In another embodiment, a window frame assembly is described comprising a framing member for installing pre-glazed windows with or without a rotatable rod means in the framing member, said member including a separately attachable leg member for attaching the pre-glazed window to a pre-installed sub-framing member. In still other embodiments, window frame assemblies are described comprising novel mullions for joining pairs of pre-glazed windows. The mullions, as described, may optionally include means for the attachment of a partition and the aforementioned rotatable rod means.

18 Claims, 10 Drawing Figures

WINDOWS AND METHOD OF MAKING THE SAME

BACKGROUND OF THE INVENTION

The installation of a glazing product, such as a sheet of glass, a sheet of plastic, a ventilator and the like in an opening typically involves the use of a plurality of framing members for supporting the glazing product about its edges. The term glazing product, as commonly used in the glazing industry and as used herein, means any product which is installed in a frame erected in a wall opening or the like. The terms "glazed window" or "window", as used herein unless otherwise indicated from the context, means an assembly comprising a glazing product glazed in a frame. which is supported about its edges by a plurality of framing members or they may comprise two or more sheets of glazing product, in which case there is further provided a framing member called a mullion for joining the sheets.

The installation or erection of windows may take several forms depending on the particular type of windows, the number and arrangement of the windows and the nature of the opening in which they are erected. In one type of erection, a part of the framing members used for supporting the windows is installed in the opening. The glazing product is then inserted and a glazing stop attached for retaining the glazing product in the frame. Caulking, putty or other sealants are then inserted between the framing members and the glazing product to seal the window against the weather.

The erection of windows in the manner just described is time-consuming and costly because of the labor involved. This is particularly true in the erection of windows in high-rise buildings because of the precautions that must be taken in transporting unsupported glass sheets.

Principally for these reasons, the glazing industry has turned to a more efficient method of erecting windows in which the windows are factory glazed. That is, the glazing products are glazed in their framing members before being taken to the jot site. Once at the job site, they are installed over a pre-installed sub-framing member or otherwise fixed in a prepared opening.

The present invention is in part related to these types of windows — that is, to novel window frame assemblies which may be pre-glazed at the factory.

With the advent of new glazing products and because of the aesthetic and beneficial characteristics of windows, windows are being used more frequently in place of steel bars and the like for enclosing openings in security areas, such as prisons, warehouses, and the like.

When used in such applications, it is obviously necessary to prevent entry of the window. This requires not only the use of an unbreakable glazing product but also the employment of means for preventing destruction of the framing members holding the glazing product.

Presently, the most widely used materials for window framing members are aluminum and relatively thin steel. Both of these materials are relatively easy to saw or otherwise cut. Consequently, so far as it appears, others, heretofore, have been dissuaded from attempting to replace barred openings and the like with ordinary appearing, but much more aesthetically pleasing windows on a large scale.

To prevent a successful entry through a window using such framing materials, the present invention employs rotatable rod members in each of the framing members.

The use of rotatable rod members is known to have been proposed long ago for use in prison bars and the like for preventing the successful sawing or cutting thereof, but so far as is known, no one heretofore has suggested their use for preventing the destruction of an otherwise relatively easily destructable window framing member.

SUMMARY OF THE INVENTION

In view of the foregoing, a principal object of the present invention is a novel window frame assembly and method for fabricating pre-glazed windows comprising novel framing members. Another object of the invention is a novel mullion for installing pre-glazed windows. Another object of the present invention is a window frame assembly comprising means for preventing the cutting through of a framing member as by a saw or the like.

In accordance with the above objects, there is provided in one embodiment of the present invention, a window frame assembly having framing members comprising: a T-shaped framing member; a glazing stop with means for attaching said stop to said T-shaped member to form a U-shaped channel for securing a glazing product; and an L-shaped framing member with means for attaching said L-shaped member to said T-shaped member to form a U-shaped channel for securing said framing member to a pre-installed sub-framing member.

In another embodiment of the present invention, rotatable rod means are provided in a framing member for preventing the sawing through of said framing member. In this embodiment, a means is also employed for preventing the non-destructive disassembly of the framing member.

In still other embodiments of the present invention, there is provided a novel mullion means for erecting a pair of pre-glazed windows with and without means for preventing the non-destructive disassembly of said mullion means. In certain ones of these embodiments, a means is optionally provided for the attachment of a partition.

DESCRIPTION OF THE DRAWINGS

The above and other objects, features and advantages of the present invention will be apparent from the following detailed description of the accompanying drawings in which.

DETAILED DESCRIPTION

The terms "glazing product", while typically used in reference to one or more sheets of glass, are considered in the glazing industry, and are used herein, as referring to any product — e.g., a sheet of glass, a sheet of plastic or a ventilator assembly — which is capable of being glazed in a frame. Similarly, the term "window" is considered in the glazing industry, and is used herein, as referring not merely to the glazing product but rather to the entire assembly of glazing product and supporting frame members.

With respect to the following description, it should also be understood that all of the novel framing members of the present invention need not necessarily be identical in any given installation but that, depending on the application, one or more of the members in a given installation may be constructed somewhat differently. For example, the header and jamb framing members may be identical in cross-section, while the sill framing member is constructed for attachment using sill clips and the like. Such features are considered conventional and form no part of the present invention beyond the fact that they may be used as required with framing members made in accordance with the invention.

Figure 2:
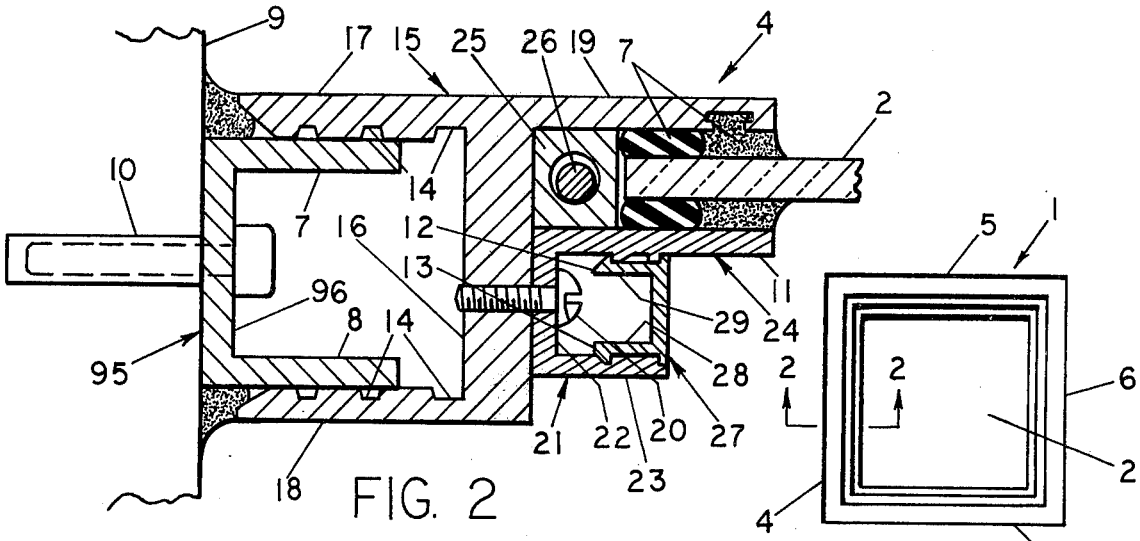
FIG. 2 is a cross-sectional view taken along lines 2—2 of FIG. 1.
Figure 1:
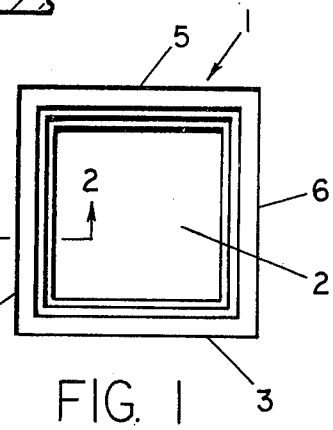
FIG. 1 is an elevation view of a single window unit in accordance with the present invention.

Referring to FIGS. 1–2, there is provided in accordance with the present invention a window 1 comprising a glazing product 2 which is supported in a plurality of framing members 3, 4, 5 and 6. For purposes of describing the present invention, each of the framing members 3–6 has an identical cross-section. It is understood, however, that one or more of them may be constructed differently for adaptation to the requirements of a particular installation. Accordingly, only one of the framing members, member 4, need be described.

Referring to FIG. 2, there is provided in framing member 4 a sub-framing member 95. Member 95 typically comprises a U-shaped channel having a base section 96 and a pair of spaced parallel leg members 7 and 8 extending therefrom. For attachment to a jamb, comprising a concrete or wooden surface 9, or the like, there is provided one or more attaching fittings 10 which, depending on the application, may comprise a lag bolt, screw, nut and bolt, or the like. Fittings 10, only one of which is shown, are positioned at preselected intervals along the length of the framing member.

Fitted about the sub-framing member 95 is an *h*-shaped framing member 15. Member 15 has a relatively thick base section 16 from which extend in opposite directions a pair of spaced parallel leg members 17 and 18 and a single leg member 19. Members 17 and 18 form a U-shaped channel for receiving the member 95. Member 19 forms a part of another U-shaped channel for receiving the glazing product 2. To reduce weight and conserve material, the interior surfaces of leg members 17 and 18 are provided with a plurality of parallel extending grooves or recesses 14, 14 . . . .

Spaced from leg member 19 and attached to section 16 of member 15 as by a screw 20 is a U-shaped glazing stop 21. Stop 21 has a base section 22 from which extend a pair of spaced parallel leg members 23 and 24. Leg member 24 is provided with an extended section 11 and is, therefore, somewhat longer than member 23 such that it is substantially coextensive with member 19. The U-shaped channel thus formed between leg members 19 and 24 serves as a receiving space for the glazing product 2.

Mounted at selected locations along the length of framing member 4 in the channel formed by leg members 19 and 24 is one or more block members 25. Each of block members 25 is provided with a hole through which is passed an elongated rotatable rod member 26. The length of the member 26 is preferably substantially equal to the length of the framing member 4. The holes have a diameter slightly larger than the diameter of the rod member so as to allow the rod member to rotate freely therein. The number, size and location of the blocks 25 in each of the framing members 3–6 are chosen such that any expected lateral forces on the rod member 26 are insufficient to bend and bind the rod member by friction in the holes so as to prevent its free rotation. Also, the blocks 26 are preferably formed from a material having a low coefficient of friction and the rod member 26 is formed from a material having the hardness and resistance to cutting as by sawing of tool steel.

The purpose, therefore, of the blocks is to serve as a bearing surface for the rod member 26 such that, if any attempt is made to saw through the framing member 4, the saw, when contacting the rod member 26, will cause the rod member to rotate in the blocks. This is effective to prevent cutting of the rod member. From the foregoing, it follows that, for long lengths of rod, the rod member 26 should be supported at several points so as to prevent its being bent by a saw such that it becomes bound in a block and can then be cut.

To prevent non-destructive dissassembly of the window 1, there is further provided a non-removable cover member 27. Member 27, after the window is installed, is inserted between the legs of stop 21 to cover the screw means 20.

In the cover member 27, there is provided, extending from the interior surfaces thereof, a pair of spaced leg members 28 and 29. Members 28 and 29 are, respectively, terminated by a shouldered clip-like termination 12 and 13 for non-removable engagement with a corresponding pair of engaging surfaces in the surfaces of leg members 23 and 24 of the stop 21. Termination 12 and 13 serves to prevent the non-destructive removal of the cover 27 and, thereby, the non-destructive disassembly of the framing member 4.

To install a window according to the embodiment of FIGS. 1 and 2 in a pre-constructed opening, the sub-framing member 95 and the corresponding member in each of the members 3, 5 and 6 are fitted with a plurality of fittings 10 and inserted between the legs 17 and 18 of the *h*-shaped member 15. They are temporarily secured there as by masking tape or the like. The member 15, with the member 5 so secured, is then inserted and plumbed in the opening. Through pilot holes (not shown) in the base section 16 of member 15, which are located in registration with the fittings 10, the fittings 10 are then screwed into or otherwise fixed in the header, jambs and sill. The blocks 25 and the rod members 26 are then positioned with the glazing product 2 supported therebetween. Finally, stop 21 is installed, weather sealing material 97 is added between the glazing product 2 and leg members 19 and 24 and cover 27 is inserted.

Figure 4:
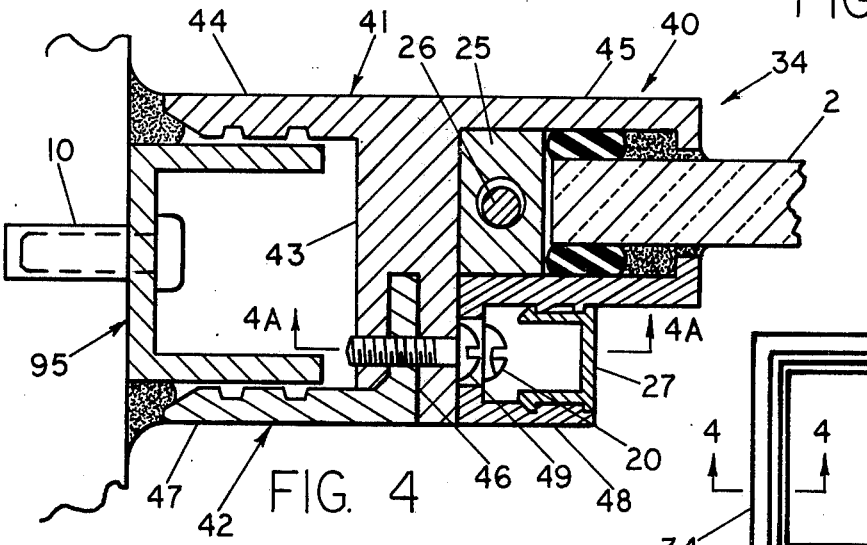
FIG. 4 is a cross-sectional view taken along lines 4—4 of FIG. 3.
Figure 3:
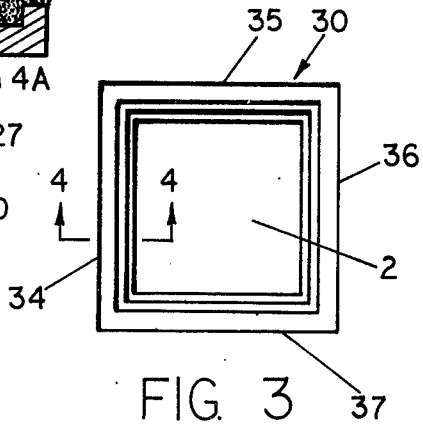
FIG. 3 is an elevation view of a single window unit in accordance with another embodiment of the present invention.
Figure 4A:
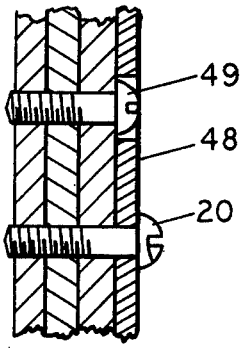
FIG. 4*a* is a cross-sectional view taken along lines 4*a*–4*a* of FIG. 4.
Figure 4B:
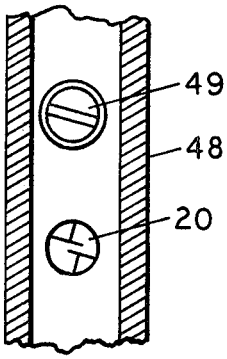
FIG. 4*b* is a top view of FIG. 4*a*.

Referring to FIGS. 3–4, there is provided in another embodiment of the present invention a window 30.

Window 30 comprises a glazing product 2, as described above with respect to FIGS. 1–2, supported in a plurality of framing members 34, 35, 36 and 37. Each of the members 34, 35, 36 and 37 is identical and accordingly only one — namely, member 34 — is described.

Referring to FIG. 4, there is provided in the member 34 a number of the features of the member 4 of FIG. 2. As to those members which are identical in both embodiments, the same numerical designators are employed for identification purposes and a reference to the discussion above is invited for the details of their construction. Included in the list of features which are identical in both embodiments are the sub-framing member 5 and fitting 10, the block 25 and rod member 26, and the cover member 27.

Figure 5:
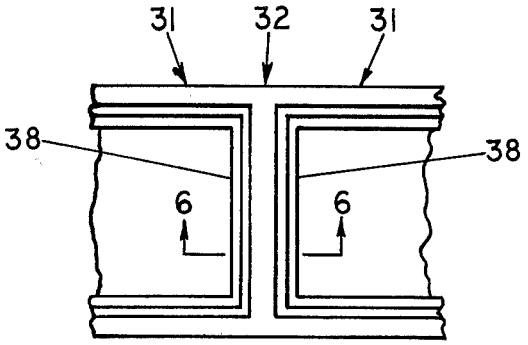
FIG. 5 is a partial elevation view of a double window unit with a mullion in accordance with the present invention.

In contrast to member 15 of FIG. 2, there are provided in the embodiment of FIG. 5, a main framing member 40 comprising two separable members, a T-shaped framing member 41 and L-shaped framing member 42. Member 41 has a thick base section 43 from which extends from one end thereof a pair of oppositely directed leg members 44 and 45. L-shaped member 42 comprises a pair of perpendicular leg members 46 and 47. In the base section 43, opposite the end from which members 44 and 45 extend, is a recess for recessing the leg 46 of member 42. Attached to the base section 43 by means of a screw means 20 is a glazing stop 48. In stop 48 and in base section 43, in communication with the recess and in registration with each other, is a pilot hole for receiving a screw means 49. Screw means 49 is used for fixedly attaching the leg member 46 in the recess in the base section 43. Because of the pilot hole in the stop 48, however, screw means 49 can be inserted and member 42 secured before stop 48 is attached. As previously described, in all other essential respects, the remaining features of the framing member 40 are identical to the same features in the member 4 of FIGS. 1–2 and reference may be made to the description above for the details with respect to those features.

Figure 6:
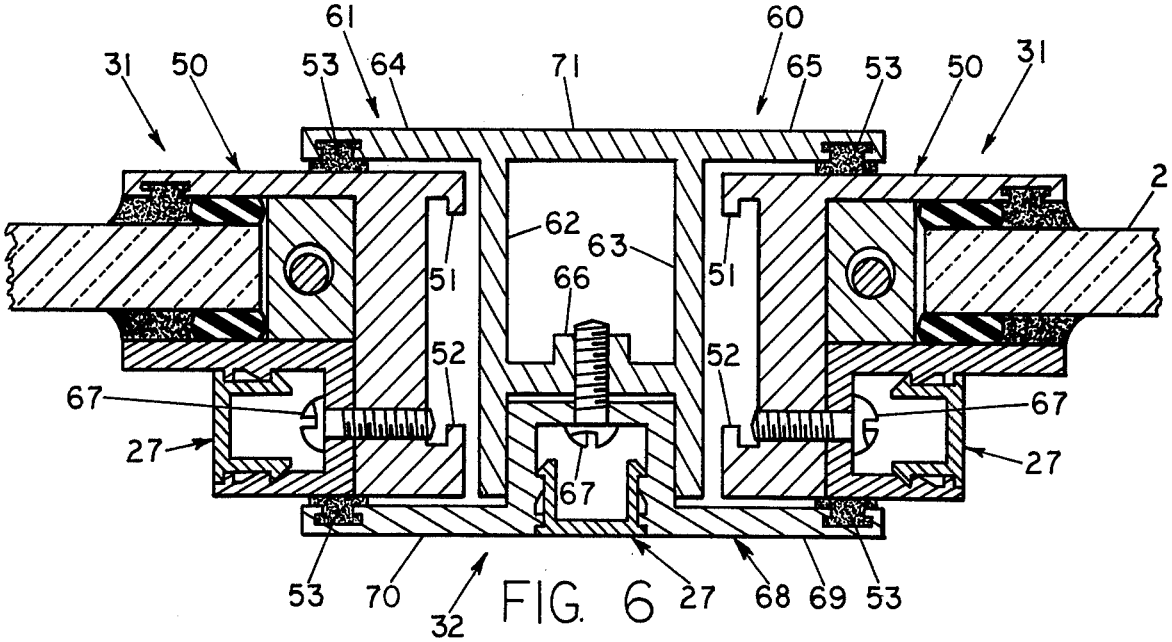
FIG. 6 is a cross-sectional view taken along lines 6—6 of FIG. 5.

Referring to FIGS. 5 and 6, there is provided a pair of window units 31, 31 which are joined by a mullion 32 according to the present invention. Windows 31, 31 may comprise the framing members of the embodiments described above except that there is typically a modification to the inside members 38, 38 . . . joined by the mullion.

In the members 38, 38 . . . there is provided an *h*-shaped main framing member 50 which is similar to the *h*-shaped member 15 described with respect to FIGS. 1–2. The only essential difference between the two members 50 and 15 is that the pair of parallel leg members 17 and 18 of member 15 are foreshortened in member 50 and terminated by a pair of inwardly directed flanges 51 and 52. In addition, a plurality of sealing members 53, 53 . . . are provided between the framing members 40, 50 . . . for weather sealing. In all other respects, the features of members 50 are identical to those of member 4 of FIG. 2.

In mullion 32 there is provided a pair of L-shaped members 60 and 61. Members 60 and 61 comprise a pair of spaced parallel leg members 62 and 63 and a pair of oppositely directed leg members 64 and 65 which are rigidly attached by a bridging member 71 and a recessed bridging member 66, recessed between the legs 62 and 63. Attached to the bridging member 66 as by a screw means 67 is a face plate 68 comprising a pair of spaced oppositely directed legs or plate members 69 and 70. The space between the plate members 69 and 70 is recessed to fit in the recess provided by the recessed bridge member 66 between the leg members 62 and 63 of the members 60 and 61. As described above with respect to the embodiments of FIGS. 1–4, screw 67 is covered by a cover member 27 which is non-removably inserted in the recess of plate 68 to engage corresponding shouldered surfaces in the interior walls thereof.

Figure 7:
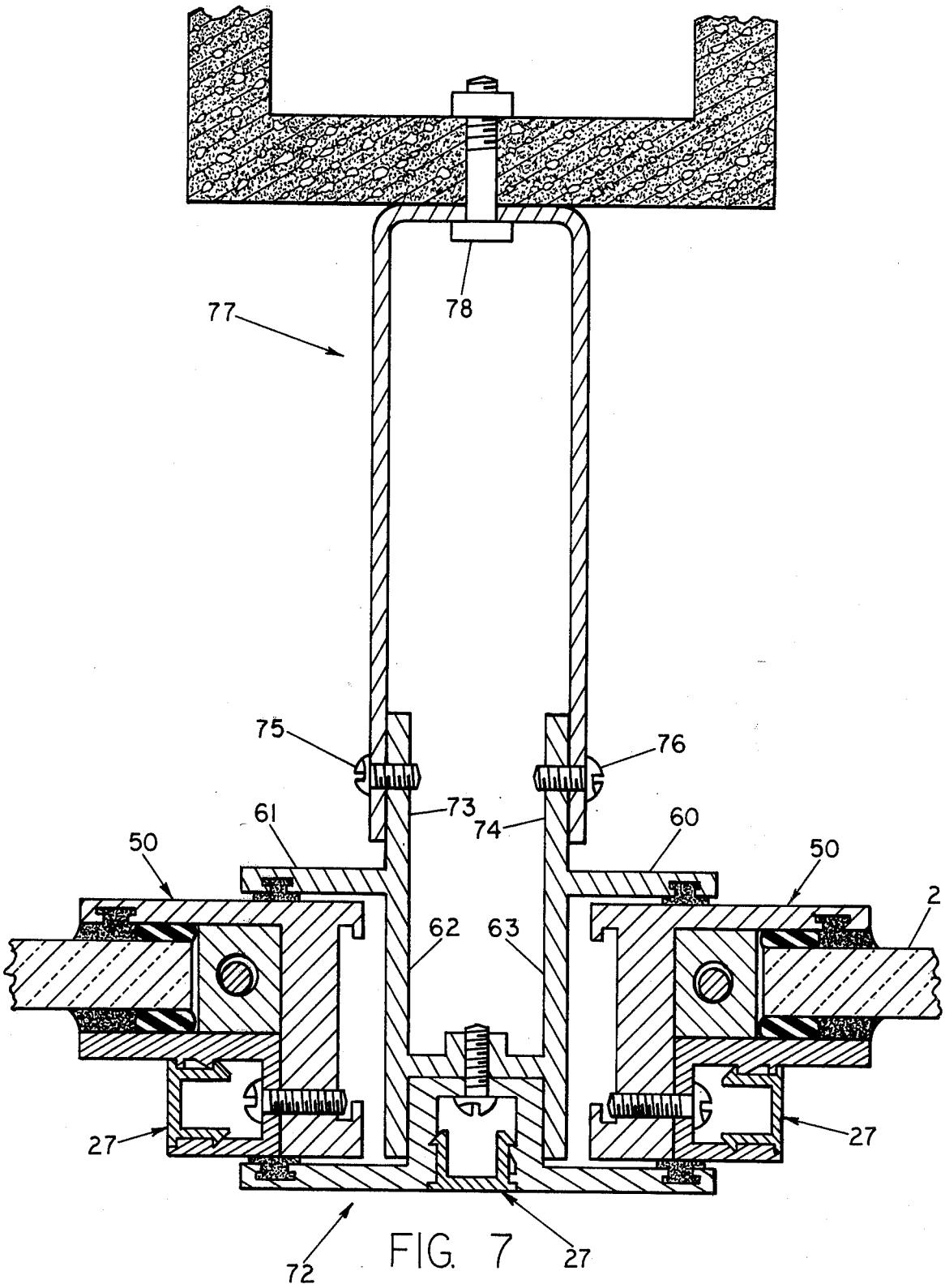
FIG. 7 is a cross-sectional view of an alternative embodiment of the mullion of FIG. 5.

Referring to FIG. 7, there is provided a mullion 72 which is an alternative embodiment of the mullion 32 of FIG. 6. In mullion 72, the bridging member 71 of FIG. 6 is omitted. Parallel leg members 62 and 63 are extended by means of a pair of parallel flange members 73 and 74 somewhat beyond the plane of leg members 60 and 61. Attached to flange members 73 and 74 as by rivets or screws 75 and 76, or the like, is an elongated U-shaped channel 77. Channel 77 may be ridigly attached to a partition, wall or the like by means of one or more fittings 78. In all other respects, the mullion 72 is identical to the mullion 32 of FIG. 6.

Figure 8:
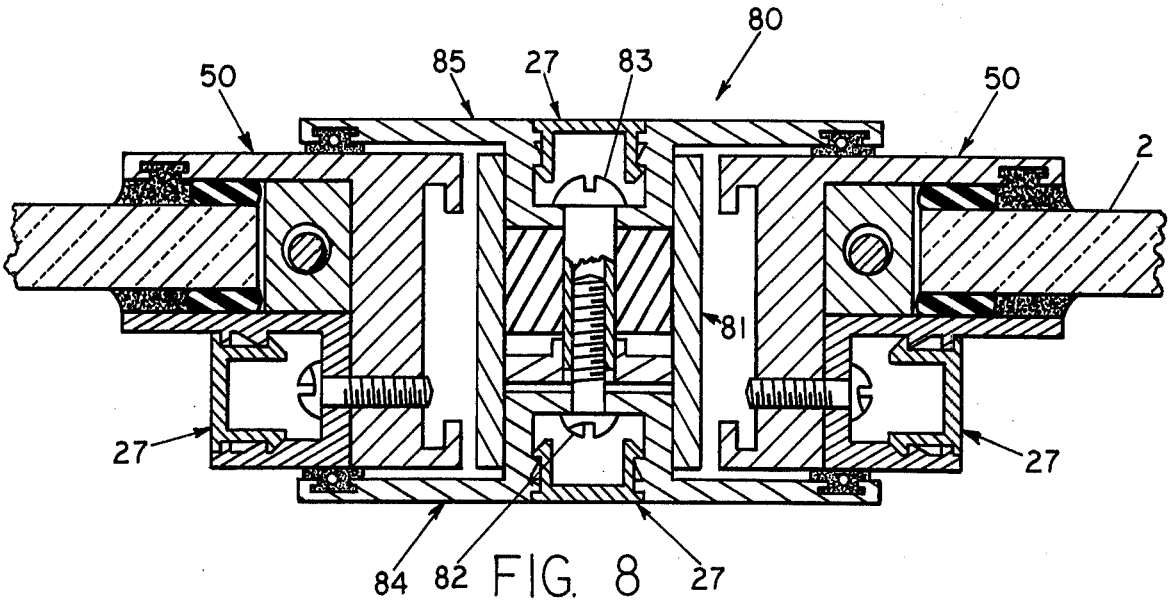
FIG. 8 is a cross-sectional view of another alternative embodiment of the mullion of FIG. 5.

In FIG. 8, there is shown yet another embodiment of a mullion according to the present invention.

Referring to FIG. 8, there is provided in a mullion 80 an H-shaped framing member 81. Attached to opposite sides of member 81, in the recesses between its parallel legs, as by screw means 82 and 83, are a pair of identical facing plate members 84 and 85. Each of plate members 84 and 85 are identical to facing plate member 68 of FIG. 6 and incorporate cover members 27, as shown in FIG. 6.

In the installation of the windows according to the embodiments of FIGS. 3–8, the sub-framing members 5 are first attached to and plumbed in the sides of a preconstructed opening in a wall or the like except for that part of the frame contiguous to a mullion. The remainder of the frame, which is preferably pre-glazed, is then inserted and the attachable L-shaped framing member 42 is fitted and tightened in the recess of the T-shaped member 41 by the screw means 49. The glazing stop 21, which is at that time already attached by the screw means 20, is then fitted with the cover 27 to cover the screw means 20 and 49.

With respect to the erection of the mullions of FIGS. 5–8, the installation procedure is equally simple since all that is required, once the mullion is in place, is the attachment of the respective face plates. With respect to the embodiment of FIG. 8, of course, the mullion can be reversed since two opposing attachable face plates are used.

It is apparent from the foregoing that various combinations of the embodiments described may be incorporated in a given installation depending on the requirements of the job. It is also apparent that various modifications can be made to the embodiments described, as required, without departing from the spirit and scope of the present invention. It is, therefore, intended that the embodiments described serve only as illustrations of the present invention and that the true scope of the invention be determined by reference to the claims hereinafter provided.

What is claimed is:

1. In a window frame assembly having framing means for supporting a glazing product, said assembly comprising:

a sub-framing member;

an *h*-shaped framing member having a single leg portion and a U-shaped portion, said U-shaped portion being adapted to fit over said sub-framing member;

means forming a glazing stop;

means for attaching said glazing stop to said *h*-shaped framing member to form, in cooperation with said single leg portion of said *h*-shaped member, a U-shaped channel about a peripheral edge of said glazing product;

saw proofing means including rotatable means disposed within said U-shaped channel; and means for preventing the non-destructive removal of said glazing stop from said *h*-shaped framing.

2. In a window frame assembly according to claim 1, wherein said *h*-shaped framing member comprises:

a T-shaped framing member;

an L-shaped framing member; and means for attaching said L-shaped framing member to said T-shaped framing member, said means for preventing removal of said glazing stop also preventing non-destructive removal of said L-shaped framing member from said T-shaped framing member.

3. The improvement according to claim 2 wherein said means for attaching said L-shaped framing member to said T-shaped framing member comprises a recess in said T-shaped framing member for receiving one leg of the L-shaped framing member, said other leg of said L-shaped framing member extending from said recess so as to form, in cooperation with said T-shaped framing member, said U-shaped portion of said *h*-shaped framing member.

4. The improvement according to claim 3 wherein said T-shaped framing member comprises a pair of oppositely directed leg members and an intermediate leg member extending perpendicularly therefrom, said recess being disposed within said intermediate leg member, and said means for attaching said L-shaped framing member to said T-shaped framing member comprising a screw receiving means to secure said one leg of said L-shaped member in said recess.

5. A window frame assembly for supporting a glazing product comprising:

a sub-framing member;

means for mounting said sub-framing member to selected portions of the inside perimeter of an opening in a wall and the like;

a T-shaped framing member;

an L-shaped framing member;

a glazing stop framing member;

means for attaching said L-shaped framing member to said T-shaped framing member to form a first U-shaped channel over said sub-framing member; and means for attaching said glazing stop framing member to said T-shaped framing member to form a second U-shaped channel about an edge of said glazing product.

6. An assembly according to claim 5 wherein said glazing stop framing member attaching means comprises first screw means, said L-shaped framing member attaching means comprises second screw means, and said means for attaching said glazing stop framing member and said L-shaped framing member independently to said intermediate leg of said T-shaped framing member comprises a pilot hole in said glazing stop framing member for receiving said second screw means.

7. An assembly according to claim 6 further comprising means including rotatable means disposed within said second U-shaped channel for preventing the sawing through of said framing members with a sawing means.

8. An assembly according to claim 7 wherein said rotatable means comprises rotatable rod means and said preventing means further comprises means for supporting said rod means in said second U-shaped channel in a manner allowing said rod means fo freely rotate in said second U-shaped channel when contacted in a sawing manner by said sawing means.

9. An assembly according to claim 8 wherein said supporting means comprises blocks of material having a relatively low coefficient of friction and a hole for receiving said rod means, and further wherein each of said blocks is located at a preselected position in said second U-shaped channel.

10. An assembly according to claim 9 wherein said preselected positions in said second U-shaped channel are chosen for preventing bending and friction binding of said rod means in said blocks upon the application of a laterally applied force on said rod means by said sawing means.

11. An assembly according to claim 10 further comprising means for preventing non-destructive removal of said glazing stop framing member and said L-shaped framing member from said intermediate leg member.

12. An assembly according to claim 11 wherein said glazing stop framing member comprises a U-shaped glazing stop framing member, said first and said second attaching screw means comprises screw means located in the base of said U-shaped glazing stop framing member and said means for preventing non-destructive removal of said glazing stop and said L-shaped framing members comprises a non-removable cover means insertable between the legs of said U-shaped glazing stop framing member for covering said screw means.

13. A window frame assembly for supporting a glazing product comprising:

a sub-framing member;

means for mounting said sub-framing member to selected portions of the inside perimeter of an opening in a wall and the like;

a T-shaped framing member;

an L-shaped framing member;

a glazing stop framing member;

means for attaching said L-shaped framing member to said T-shaped framing member to form a first U-shaped channel over said sub-framing member;

means for attaching said glazing stop framing member to said T-shaped framing member to form a second U-shaped channel about an edge of said glazing product;

a first mullion member;

a second mullion member; and means for attaching said second mullion member to said first mullion member for forming a pair of oppositely directed U-shaped channels, each of said channels being adapted to enclose a portion of a glazed window means.

14. An assembly according to claim 13 wherein each of said U-shaped channels comprises a pair of parallel leg members and an intermediate base portion, said first mullion member comprises:

a pair of spaced L-shaped members having parallel and oppositely directed leg members which are rigidly interconnected by an intermediate bridging member for forming said base portion and one of said pair of parallel leg members of each of said U-shaped channels;

said second mullion member comprises a facing plate having a pair of oppositely directed wall portions substantially coextensive with said oppositely directed leg members for forming the other of said pair of parallel leg members of each of said U-shaped channels; and said attaching means comprises means for attaching said second mullion member to said bridging member.

15. An assembly according to claim 14 wherein said bridging member is recessed from the ends of said parallel legs of said L-shaped members, said facing plate is provided with a corresponding recessed portion between its oppositely directed wall portions and said attaching means comprises screw means for attaching said facing plate to said bridging member in said recessed portion.

16. An assembly according to claim 15 further comprising means insertable in said recessed portion for covering said screw means, said covering means including means for preventing non-destructive removal of said covering means from said recessed portion.

17. An assembly according to claim 16 further comprising means extending from said L-shaped members for attaching a partition means to said first and said second mullion members.

18. A window frame assembly for supporting a glazing product comprising:

a sub-framing member;

means for mounting said sub-framing member to selected portions of the inside perimeter of an opening in a wall and the like;

a T-shaped framing member;

an L-shaped framing member;

a glazing stop framing member;

first means for attaching said L-shaped framing member to one side of the leg of said T-shaped framing member to form a first U-shaped channel over said sub-framing member;

second means for attaching said glazing stop framing member to the other side of the leg of said T-shaped framing member to form a second U-shaped channel about an edge of said glazing product, each of said U-shaped channels comprising a pair of leg members and an intermediate base portion, said T-shaped framing member including a pair of oppositely directed leg members for forming, respectively, one of said pair of leg members of said first and said second U-shaped channels and an intermediate leg member extending perpendicularly to said first and said second leg members for forming said base portion, said L-shaped framing member including a pair of mutually perpendicular leg members for forming, by means of one of said leg members, the other of said pair of leg members of said first U-shaped channel, said glazing stop framing member including a leg member for forming the other of said pair of leg members of said U-shaped channel, and said means for attaching said L-shaped framing member to said T-shaped framing member including a recess in said intermediate leg member for receiving the other of said pair of leg members of said L-shaped framing member.

* * * * *